US005836778A

United States Patent [19]

Fan

[11] Patent Number: 5,836,778

[45] Date of Patent: Nov. 17, 1998

[54] LAMP CONNECTOR

[76] Inventor: Tsui-tuan Wong Fan, 15th Fl. - D, No. 81, Sec. 1, Hsintai 5th Rd., Hsitzu Chen, Taipei Hsien, Taiwan

[21] Appl. No.: 822,571

[22] Filed: Mar. 19, 1997

[51] Int. Cl.[6] ..... H01R 33/08

[52] U.S. Cl. ..... 439/235

[58] Field of Search ..... 439/235, 242, 439/427, 541, 368

[56] References Cited

U.S. PATENT DOCUMENTS 2,814,787 11/1957 Jessup ..... 439/235

*Primary Examiner*—Gary F. Paumen
*Attorney, Agent, or Firm*—Hedman, Gibson & Costigan, P.C.

[57] ABSTRACT

A lamp connector includes a terminal base connected between two opposed ends of adjacent lamps and an enclosure receiving the two opposed ends and the terminal base. The enclosure is composed of a first part and a second part opposed to each other. The first part of the enclosure has a cross section shaped as an "L" and the second part of the enclosure has a cross section shaped as an inverted "L" so as to define a cuboid space therein for receiving two adjacent lamps with rectangular cross sections. The first part and the second part further have a series of ribs extending from an inside wall thereof for fastening the two opposed ends of the lamps. Also, each lamp has two series of bulbs arranged in a manner that the bulbs of one series are staggered with those of the other series so that it provides a subdued light effect under the control of a control circuit.

6 Claims, 5 Drawing Sheets

LAMP CONNECTOR

BACKGROUND OF THE INVENTION

1. Field of the Invention

The present invention relates to a lamp connector, and more particularly to a lamp connector with simple operation and a subdued light effect.

2. Description of Related Art

A decorative lamp is made by numerous small lamp bulbs being connected in series and coated with flexible and transparent plastic material so that soft light can be emitted to provide a decorative effect. Since the bulbs are connected in series, it is important to provide a secure connecting device between adjacent bulbs. A conventional connector generally has a structure as shown in FIG. 6, which comprises a connection 80 and two tapered sleeves 81. The connection 80 has a plate 801 arranged in a middle position thereof and a plurality of pins 802 extending through the plate 801. Two male threaded ends of the connection 80 are provided for respectively receiving the opposed ends of two adjacent lamps 90. Each of the ends of the connection 80 have several slits 803 defined therein. When in assembly, two lamps 90 are respectively inserted into the respective sleeve 81 and engage with the plate 801 via the pins 802 extending into the pin hole 91 defined in the lamp 90. Then the tapered sleeves 81 are respectively and threadedly connected with the ends of the connection 80 so as to force the walls with the slits 803 to deform the ends to clamp the opposed ends of the lamps 90.

Though this kind of connector device can provide a clamping effect to the lamps 90, the contact area of clamping is limited so that is may not prevent the lamps separating from the connector device. Secondly, the connector device is designed for lamps with a tubular configuration, so that it is not able to be adapted to other lamps having different shapes. Furthermore, to obtain a subdued light effect, the conventional lamp has a series of bulbs therein electrically connected in a manner of jumper connection so that a curve action may cause a short circuit of the bulbs.

The present invention provides an improved lamp connector of lamps to mitigate and/or obviate the aforementioned problems.

SUMMARY OF THE INVENTION

One object of the present invention is to provide a lamp connector with easy operation and efficient fastening effect.

Another object of the present invention is to provide a lamp connector which provides a subdued light effect by means of a simple arrangement of the bulbs.

In accordance with one aspect of the present invention, a lamp connector comprises an enclosure engaged between two adjacent lamps. The enclosure is composed of a first part and a second part opposed to wash other. A space is defined within the enclosure for respectively receiving two opposed ends of the adjacent lamps. The enclosure further has a series of ribs extending from an inside wall thereof for fastening the two opposed ends of the lamps. A terminal base is disposed within the space of the enclosure and connected between the opposed ends of adjacent lamps. The terminal base includes an isolated pedestal and a plurality of pins extending through the pedestal to be inserted into a plurality of corresponding pin holes in the opposed ends of the lamps.

In accordance with another aspect of the present invention, the first part of the enclosure has a first cross section shaped as an "L" and the second part of the enclosure has a cross section shaped as an inverted "L" so as to define a cuboid space therein for receiving two adjacent lamps with rectangular cross sections.

In accordance with a further aspect of the present invention, the ribs formed in an inside of the enclosure are individually shaped as an "L" and an inverted "L" according to the first part and the second part.

In accordance with still a further aspect of the present invention, each lamp has two series of bulbs arranged in a manner that the bulbs of one series are staggered with those of the other series.

Other objects, advantages and novel features of the invention will become more apparent from the following detailed description when taken in conjunction with the accompanying drawings.

DETAILED DESCRIPTION OF PREFERRED EMBODIMENT

Figure 1:
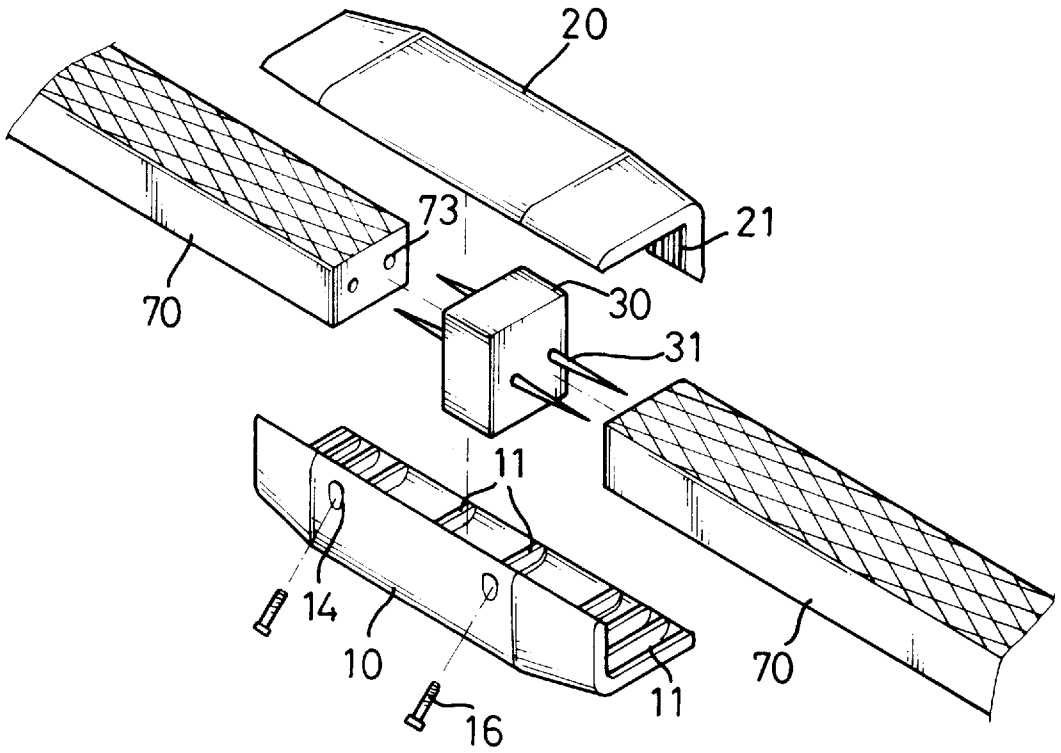
FIG. 1 is an exploded view showing a lamp connector in accordance with the present invention.
Figure 3:
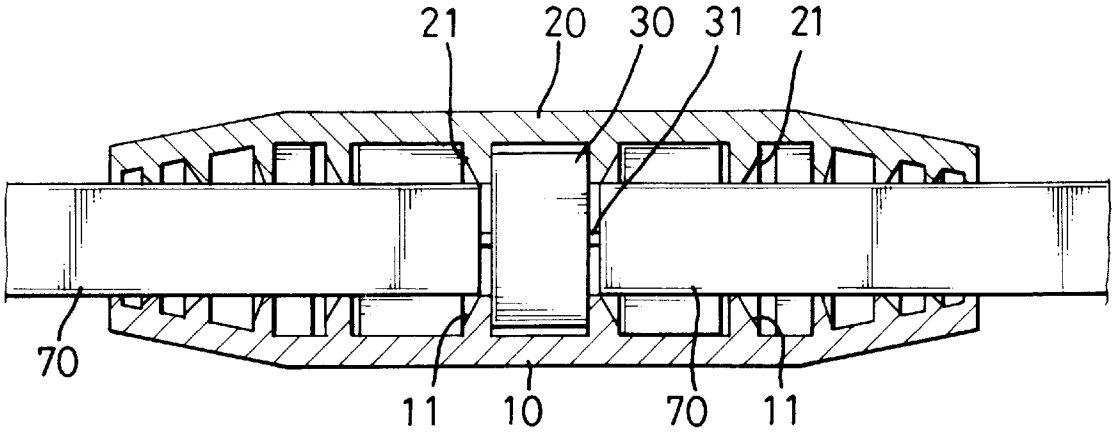
FIG. 3 is a longitudinal sectional view showing the connection of lamps in accordance with the present invention.

Referring to FIG. 1, a lamp connector comprises an enclosure (not numbered) connected between two adjacent lamps 70. The enclosure is provided with a first part 10 and a second part 20 opposed to the first part 10. In a preferred embodiment of the present invention, it can be seen that the first part 10 of the enclosure has a cross section shaped as an "L" and the second part 20 of the enclosure has a cross section shaped as an inverted "L" so as to define a cuboid space (not numbered) therein for receiving two adjacent lamps 70 with rectangular cross sections. A terminal base 30 and two opposed ends 71 of two adjacent lamps 70 are received within the cuboid space in a manner that the terminal base 30 is connected between the two opposed ends 71. The terminal base 30 has an isolated pedestal (not numbered) and a plurality of pins 31 extending therethrough to be inserted into a plurality of corresponding pin holes 74 in the respective opposed ends 71 of each of the lamps 70. It is to be noted that the quantity of the pins 74 is corresponding to that of the pin holes 73. In this embodiment, a pair of the pins 31 on the terminal base 30 is corresponding to a pair of pin holes 74 in each end 71 of the lamp 70. Also, a series of first ribs 11 extend from an inside wall of the first part 10 and a series of second ribs 21 extend from an inside wall of the second part 20 for fastening the two opposed ends 71 of the lamps 70 when received within the cuboid space. Each first rib 11 is shaped as an "L" corresponding to the first part 10 and each second rib 21 is shaped as an inverted "L" corresponding to the second part 20. Also, with a reference to FIG. 3, a pair of the first ribs 11 spaced apart a large distance is arranged in a central position of the inside wall of the first part and correspondingly, a pair of the second ribs 21 is arranged so that the terminal base 30 can be exactly retained therebetween. The remainder ribs 11 and 21 spaced apart a small distance are arranged at both ends of the enclosure in order to securely fasten the opposed ends 71 of the lamps 70.

Figure 2:
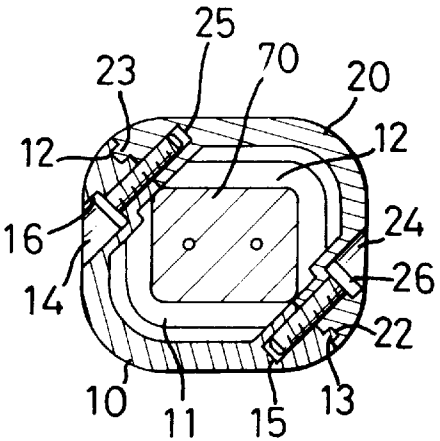
FIG. 2 is a cross sectional view showing the connection of lamps in accordance with the present invention.

Referring to FIG. 2, the first part 10 defines a first groove 12 at a first junction with the second part 20 and a second tongue 13 at a second juncture with the second part 20, respectively. The second part 20 respectively defines a second groove 23 at the first junction to correspond to the first groove 12 and a first tongue 22 at the second juncture to correspond to the second tongue 13. With this configuration, the first part 10 and the second part 20 can be combined via the first groove 12 mating with the first tongue 22 and the second groove 23 mating with the second tongue 13. Furthermore, the first part 10 defines a first hole 14 obliquely extending through the wall thereof at the first junction to be communicated with a first threaded blind hole 25 extending into the wall of the second part 20. The second part 20 defines a second hole 24 obliquely extending through the wall thereof at the second junction to be communicated with a second threaded blind hole 15 extending into the wall of the first part 10. By this arrangement, a first screw 16 can be received in the first hole 14 and screwed into the first screw hole 25 and a second screw 26 can be received in the second hole 24 and screwed into the second screw hole 15, so that the first part 10 and the second part 20 can be threadedly engaged with each other.

Figure 4:
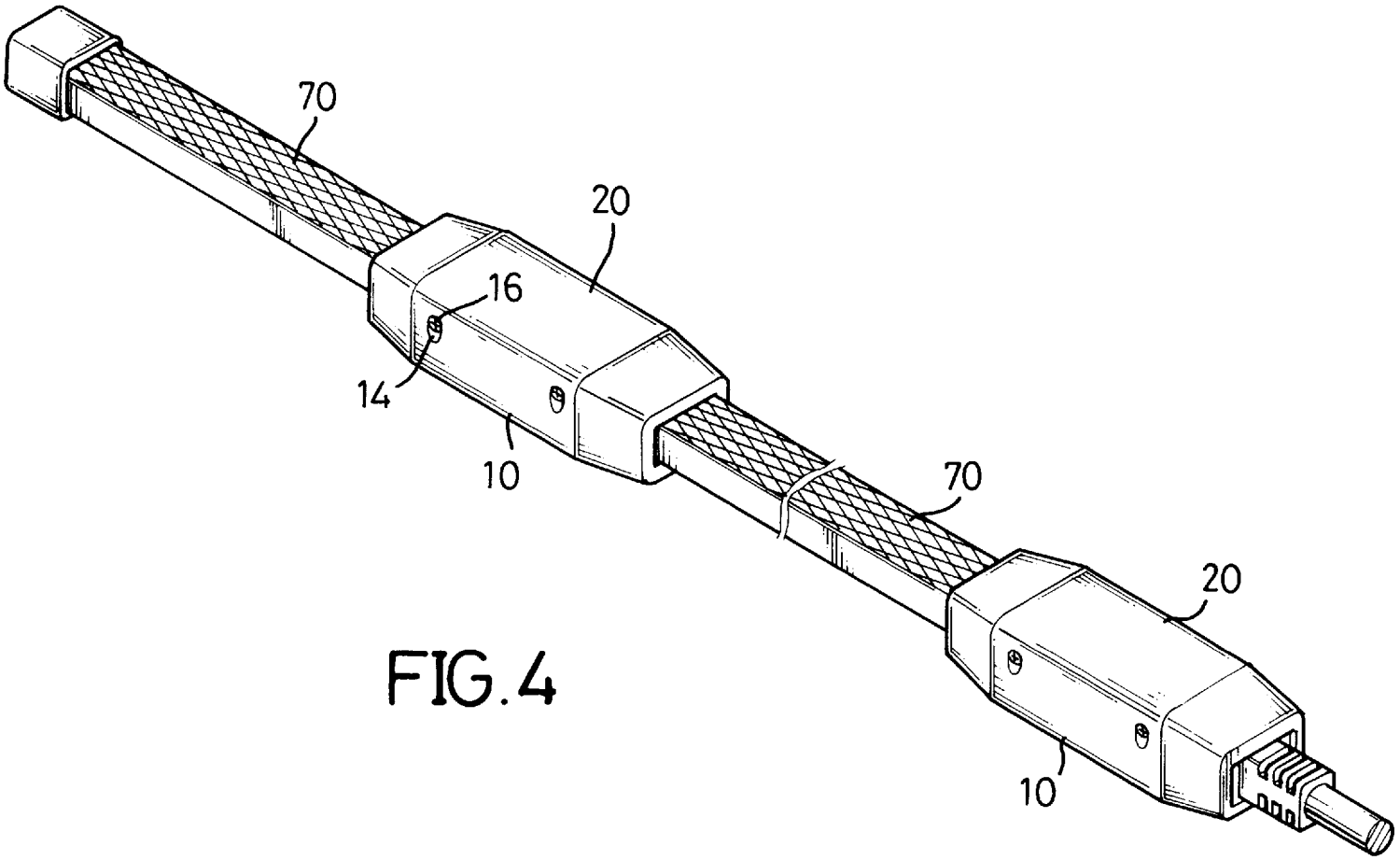
FIG. 4 is a perspective view showing the connection of lamps in accordance with the present invention.

When in assembly, referring to FIG. 4, the adjacent lamps 70 are priorly engaged with the terminal base 30, respectively, then the first part 10 and the second part 20 are combined to receive the terminal base 30 and two opposed ends 71 of the lamps 70. Next, the first screw 16 is extended into the first hole 14 and threadedly received into the first threaded blind hole 25 and the second screw 26 is extended into the second hole 24 and threadedly received into the second threaded blind hole 15 in order to engage the first part 10 with the second part 20 and clamp the opposed ends 71 of the lamps 70. Thereby, a lamp connector with simple operation and efficient fastening effect is obtained.

Figure 5:
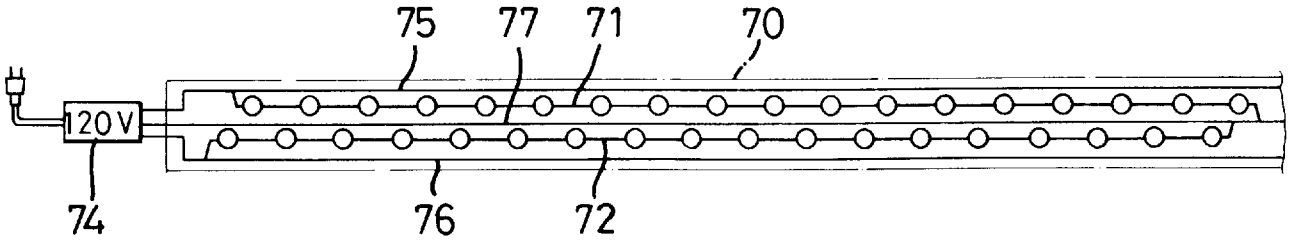
FIG. 5 is a schematic view showing the two series of bulbs within the lamp in accordance with the present invention.
Figure 6:
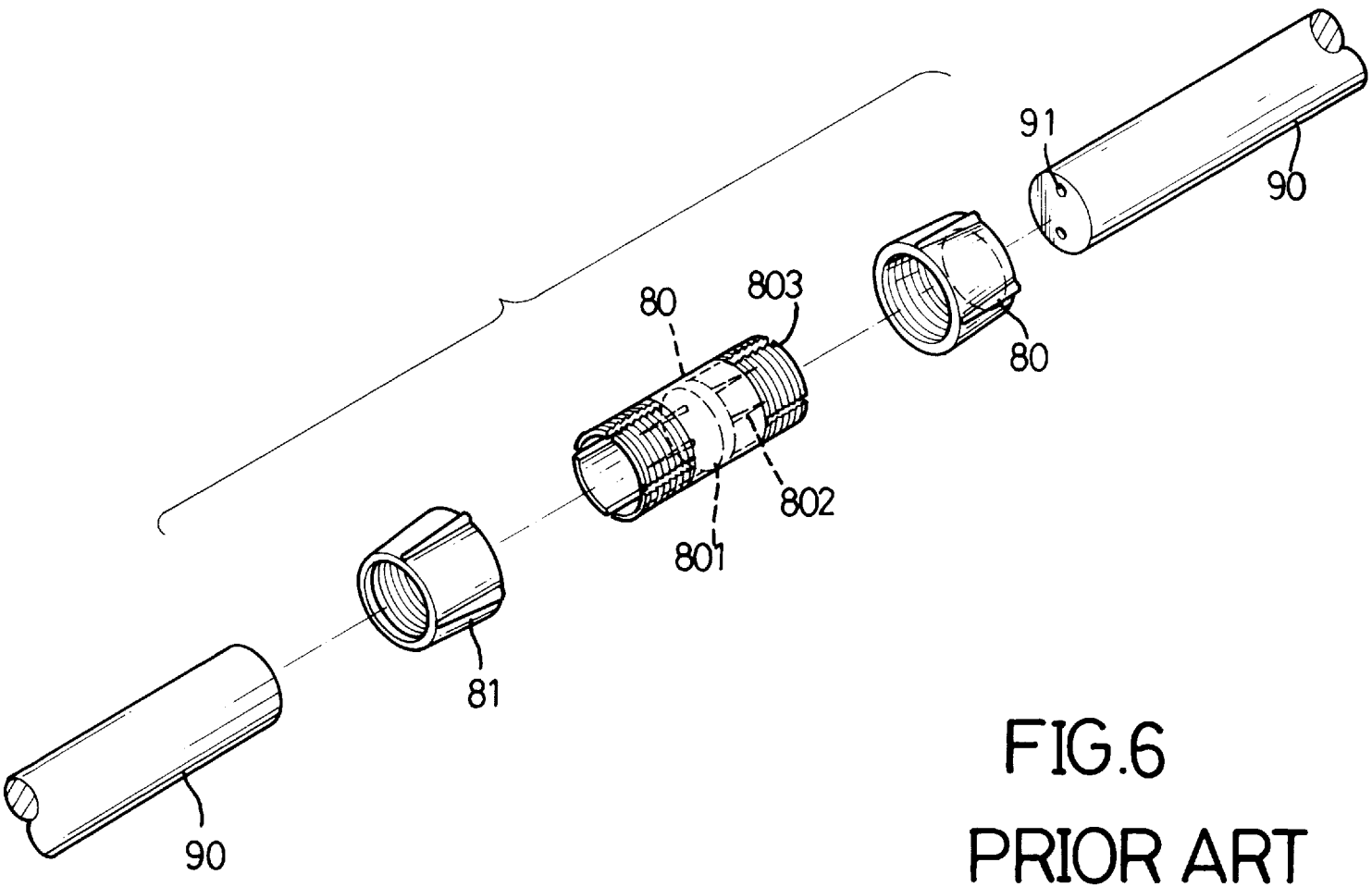
FIG.6 PRIOR ART
FIG. 6 is a perspective view showing a conventional connection of a lamp.

Referring to FIG. 5, in this embodiment, a first series and a second series of bulbs 72, 73 are disposed within each lamp 70 so that a pair of the pin holes 74 is provided correspondingly, through which two wires (not numbered) for supplying power to said series of bulbs 72, 73 can extend and be electrically connected with the pins 31. It is understood that for more series of bulbs, corresponding numbers of pin holes 74 can be adopted. Each series of bulbs 72, 73 at one end is correspondingly connected to an output 75, 76 of a control circuit 78 which is connected to the power supply (not shown), and the other end is connected to an earthing grip 77 of the control circuit 78. The control circuit 78 includes an oscillating circuit (not shown) to alternatively control the power supply of each series of the bulbs 72, 73. To obtain a subdued light effect, the two series of bulbs 72, 73 are arranged in a manner that each bulbs of one series are staggered with those of the other series in order to avoid jumper connection of the bulbs used in a conventional lamp.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A lamp connector comprising:

an enclosure engaged between two adjacent lamps, said enclosure being composed of a first part and a second part opposed to each, and defining a space therein for receiving two opposed ends of the adjacent lamps, said enclosure further having a series of ribs extending from an inside wall thereof for fastening the two opposed ends of the lamps;

a terminal base received in the space of the enclosure and connected between the opposed ends of the adjacent lamps, said terminal base having an isolated pedestal and a plurality of pins extending through the pedestal to be inserted into a plurality of corresponding pin holes in the opposed ends of the lamps.

2. The lamp connector as claimed in claim 1, wherein the first part of the enclosure has a first cross section shaped as an "L" and the second part of the enclosure has an second cross section shaped as an inverted "L" so as to define a cuboid space therein for receiving the two adjacent lamps with rectangular cross sections.

3. The lamp connector as claimed in claim 2, wherein the ribs formed in an inside of the enclosure are individually shaped as an "L" and an inverted "L" according to the first part and the second part respectively.

4. The lamp connector as claimed in claim 2, wherein said first part respectively defines a first groove at a first juncture with the second part and a second tongue at a second juncture with the second part, and wherein the second part respectively defines a second groove to correspond to the second tongue and a first tongue to correspond to the first groove, so that the first part of the second part can be combined via the first groove on the first part mating with the first tongue on the second part and the second groove on the second part mating with the second tongue on the first part.

5. The lamp connector as claimed in claim 2, wherein the first part further defines a first hole obliquely extending through the wall thereof at a first juncture to be communicated with a first threaded blind hole extending into the wall of the second part, and wherein the second part further defines a second hole obliquely extending through the wall thereof at the second juncture to be communicated with a second threaded blind hole extending into the wall of the first part, whereby a first screw can be extended into the first hole and then threadedly received in the first threaded blind hole and a second screw can be extended in the second hole and then threadedly received in the second threaded blind hole, so that the first part and the second part can be threadedly engaged with each other.

6. The lamp connector as claimed in claim 1, wherein each of said lamps has two series of bulbs arranged in a manner that the bulbs of one series are staggered with those of the other series.

* * * * *